US008826994B2

(12) United States Patent
Nguyen

(10) Patent No.: US 8,826,994 B2
(45) Date of Patent: Sep. 9, 2014

(54) FULL BORE SYSTEM WITHOUT STOP SHOULDER

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 273 days.

(21) Appl. No.: 13/124,688

(22) PCT Filed: Dec. 7, 2009

(86) PCT No.: PCT/US2009/066926

§ 371 (c)(1),
(2), (4) Date: Apr. 18, 2011

(87) PCT Pub. No.: WO2010/080273

PCT Pub. Date: Jul. 15, 2010

(65) Prior Publication Data

US 2011/0232920 A1 Sep. 29, 2011

Related U.S. Application Data

(60) Provisional application No. 61/138,773, filed on Dec. 18, 2008.

(51) Int. Cl.
*E21B 23/00* (2006.01)
*E21B 33/04* (2006.01)

(52) U.S. Cl.
CPC ..... *E21B 33/04* (2013.01)
USPC ..... 166/382; 166/378; 166/368

(58) Field of Classification Search
USPC ..... 166/379, 382, 378, 368, 208, 75.13, 166/345
See application file for complete search history.

(56) References Cited

U.S. PATENT DOCUMENTS

| | | | | |
|---|---|---|---|---|
| 4,474,236 | A | 10/1984 | Kellett | |
| 6,227,300 | B1 | 5/2001 | Cunningham et al. | |
| 2007/0007012 | A1 * | 1/2007 | Bartlett et al. | 166/344 |
| 2007/0204999 | A1 | 9/2007 | Cowie et al. | |

OTHER PUBLICATIONS

PCT/US2009/066926 International Search Report and Written Opinion, May 24, 2010 (10 p.).

* cited by examiner

*Primary Examiner* — Yong-Suk (Philip) Ro
(74) *Attorney, Agent, or Firm* — Chamberlain Hrdlicka

(57) ABSTRACT

A production assembly for controlling production from a well, the assembly including a wellhead that includes a body and a bore through the body. The bore does not include a hanger support shoulder but does include an engagement profile extending into the body. The assembly also includes a tubing hanger assembly installable in the wellhead. The assembly includes a load shoulder including a load segment expandable into supporting engagement with the bore engagement profile. The assembly also includes a tubing hanger and attached production tubing capable of being run in with the load shoulder and supportable on the load shoulder when the shoulder is engaged with the wellhead.

17 Claims, 9 Drawing Sheets

FULL BORE SYSTEM WITHOUT STOP SHOULDER

CROSS-REFERENCE TO RELATED APPLICATIONS

This application is a 35 U.S.C. §371 national stage application of PCT/US2009/066926 filed Dec. 7, 2009, which claims the benefit of U.S. Provisional Patent Application No. 61/138,773 filed Dec. 18, 2008, both of which are incorporated herein by reference in their entireties for all purposes.

BACKGROUND

Conventionally, wells in oil and gas fields are built up by establishing a wellhead housing and, with a drilling blow out preventer (BOP) adapter valve installed, drilling down to produce the borehole while successively installing concentric casing strings. The casing strings are cemented at their lower ends and sealed with mechanical seal assemblies at their upper ends. In order to convert the cased well for production, a production tubing string is run in through the BOP and a tubing hanger at its upper end is typically landed in the wellhead. Thereafter the drilling BOP is removed and replaced by a Christmas tree having one or more production bores containing valves and extending vertically to respective lateral production fluid outlet ports in the wall of the tree.

The tubing hanger is installed by a hanger running tool and the tool lowers the tubing hanger down the production bore until it lands on top of a stop shoulder. The stop shoulder is created with a decreased inner diameter portion of the housing in which the hanger is landed, which provides a permanent means to stop the lowering of the tubing hanger.

During subsequent operations, the difference in diameter of inner bore created by the permanent stop shoulder may present an inner diameter that can impede the progress of elements that are intended to be lowered past the stop shoulder. In this case, the utilization of the stop shoulder could present and inner diameter less than the inner diameter that would allow an element such as a workover tool to progress downward through the bore. If no stop shoulder were present, such and impedance would not occur and the maximum inner diameter of the production bore would be available to the operator. In addition, the standard amount of housing required between the production bore and a wellhead casing increases proportionally with the inner diameter of the production bore. If no stop shoulder is present, the amount of material can be decreased, per required standards. The absence of a stop shoulder would create "full" production bore, where the inner diameter of the production bore is limited only by the inner wall of the production bore itself.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
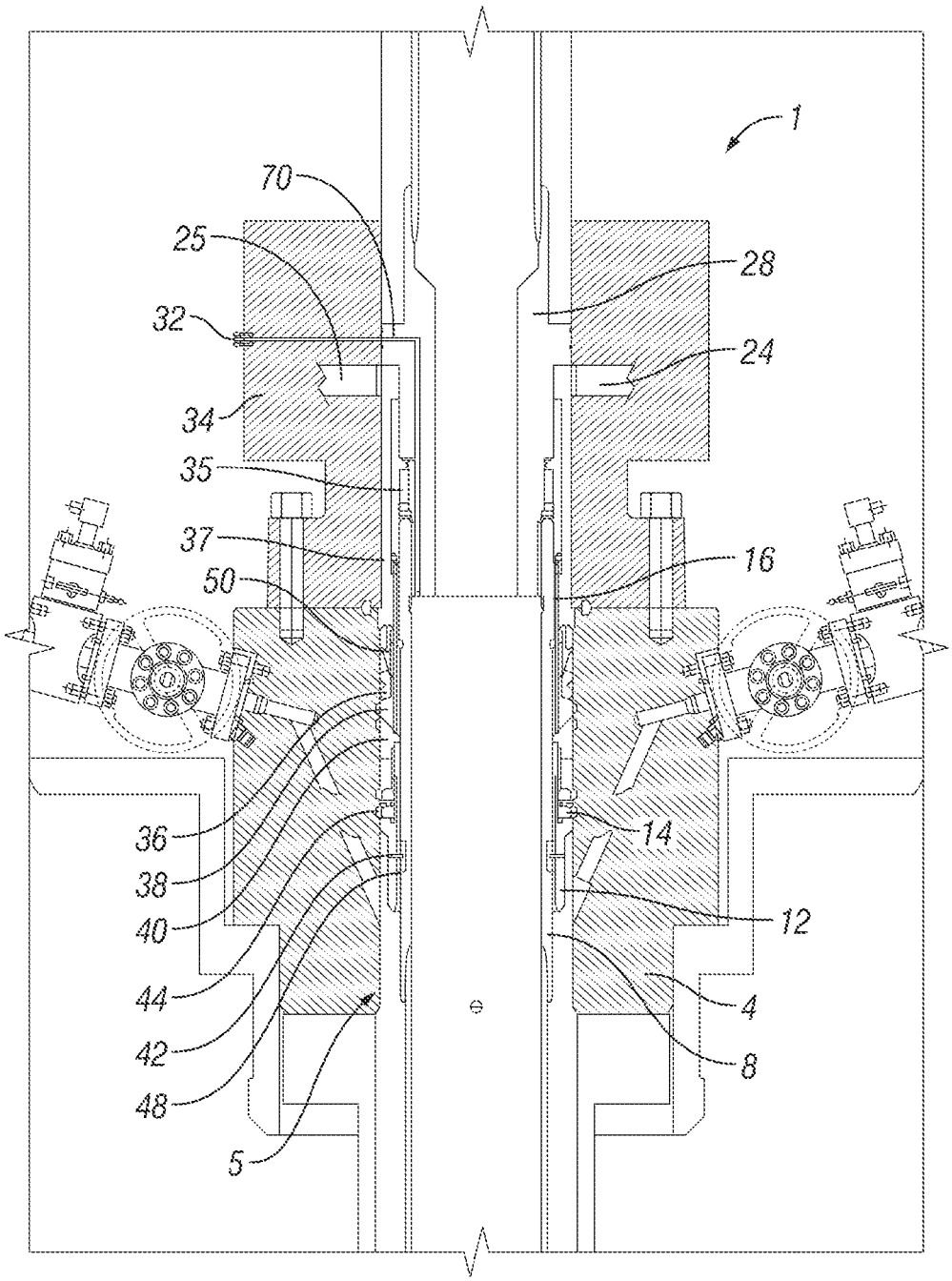
FIG. 1 is a sectional view of a full bore production system showing a production full-bore support casing.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1 there is shown a standard full bore production system 1 including a wellhead 4, a BOP adapter 34, and a hanger running tool 28. The wellhead 4 is landed on top of a conductor casing 3. The wellhead 4 controls and monitors flow, temperature, and pressure of the production fluid or gas via a plurality of valves and tubing (not shown) inside of the full bore production system 1. The BOP adapter 34 is landed atop the wellhead 4 and bolted to wellhead 4 using bolts as shown or any other suitable attachment means.

A tubing hanger system 5 is lowered through the top of the BOP adapter 34 and landed in position inside the wellhead 4 via a hanger running tool 28. The tubing hanger system 5 includes a hanger body 8 supporting a production tubing and a load shoulder 12 that includes a load segment 14. The load shoulder 12 is designed to receive loading that may be transferred during construction and operation of the full bore production system 1. The load shoulder 12 also includes an upper load sleeve 38 and a lower load sleeve 40. The load sleeves 38, 40 move independently of each other and transfer applied loading via free-fall movement of tubing hanger body 8 and a stud force pin 16 respectively. Further, hanger system 5 includes an upper lock ring 36 that is manipulated between a locked and an unlocked position by the movement of a wedge 50.

Loading transferred to the tubing hanger system 5 components in the full bore production system 1 may originate from a hanger running tool 28. The hanger running tool 28 includes a sealed port 70 for fluid communication with the BOP adapter 34 and an outer sleeve 37. The hanger running tool 28 is "run" by being lowered through the top of the BOP adapter 34 and temporarily landed inside of BOP adapter 34 using load pins 24, 25 that are manipulated between extended and withdrawn positions per operator discretion as discussed below. Although only two load pins 24, 25 are shown, it should be appreciated that as many load pins as desired may be used. The hanger running tool 28, in use, applies pressure force to the full bore production system 1 via a chamber 35 and hydraulic fluid communicated through the pressure port 32 in the BOP adapter 34.

In use, a downhole completion is initiated by drilling and completing an oil or gas production well in such a manner that the well can allow proper flow during the period in which the reservoir operates. The full bore production system 1 may be used for completing the well with the tubing hanger system 5 installed to allow communication and control of downhole functions and as a sealing mechanism for the production components that are utilized in the operation of the well.

Figure 1A:
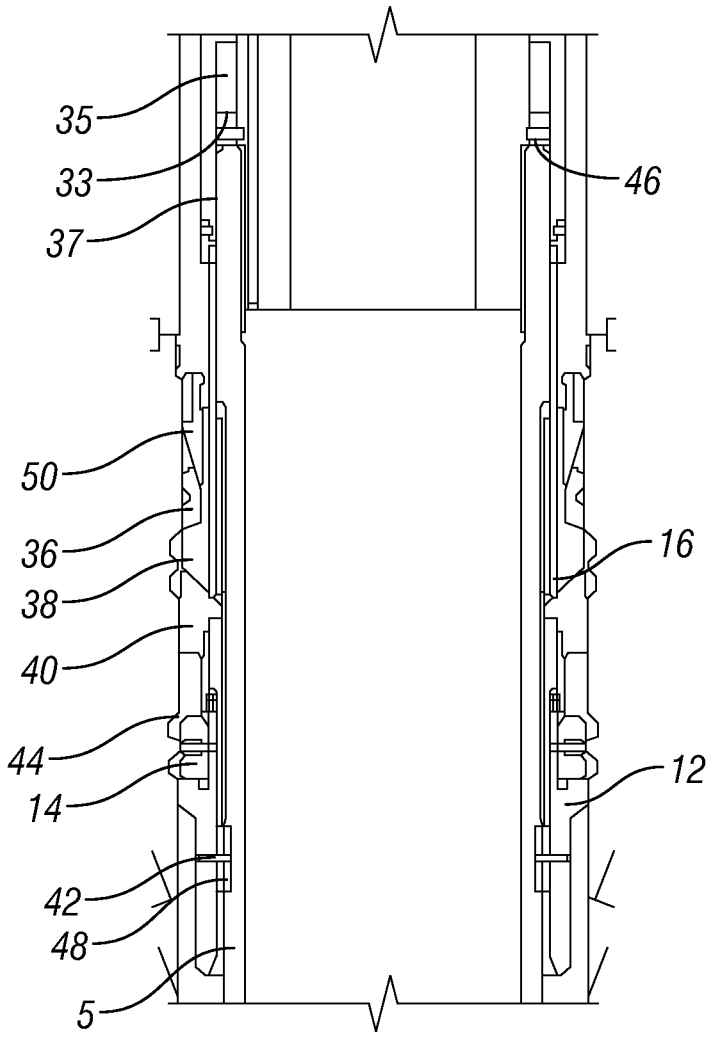
FIG. 1A shows a detailed sectional view showing a close up of some of the full bore production system components.

The tubing hanger system 5 is positioned and installed by utilizing the hanger running tool 28 to insure proper placement and to keep the tubing and control lines from becoming entangled in the system. The hanger system 5 includes the upper lock ring mechanism 36, the upper and lower load sleeves 38, 40, the outer loading sleeve 37, a stud force pin 16, and the load segment 14 mechanism. These elements provide the means for running, setting, locking, and preloading the load segment 14 mechanism without requiring the use of a permanent stop shoulder in the wellhead 4. This method will also limit the possibility of leakage in the system tubing due to the fact that the load segment mechanism can be run with the tubing hanger system 5 in a single approach—thus limiting the opportunities for potential leakage upon its removal. It should be noted that as shown in FIGS. 1 and 1A, the full bore production system 1 is in the running position configuration.

Figure 2:
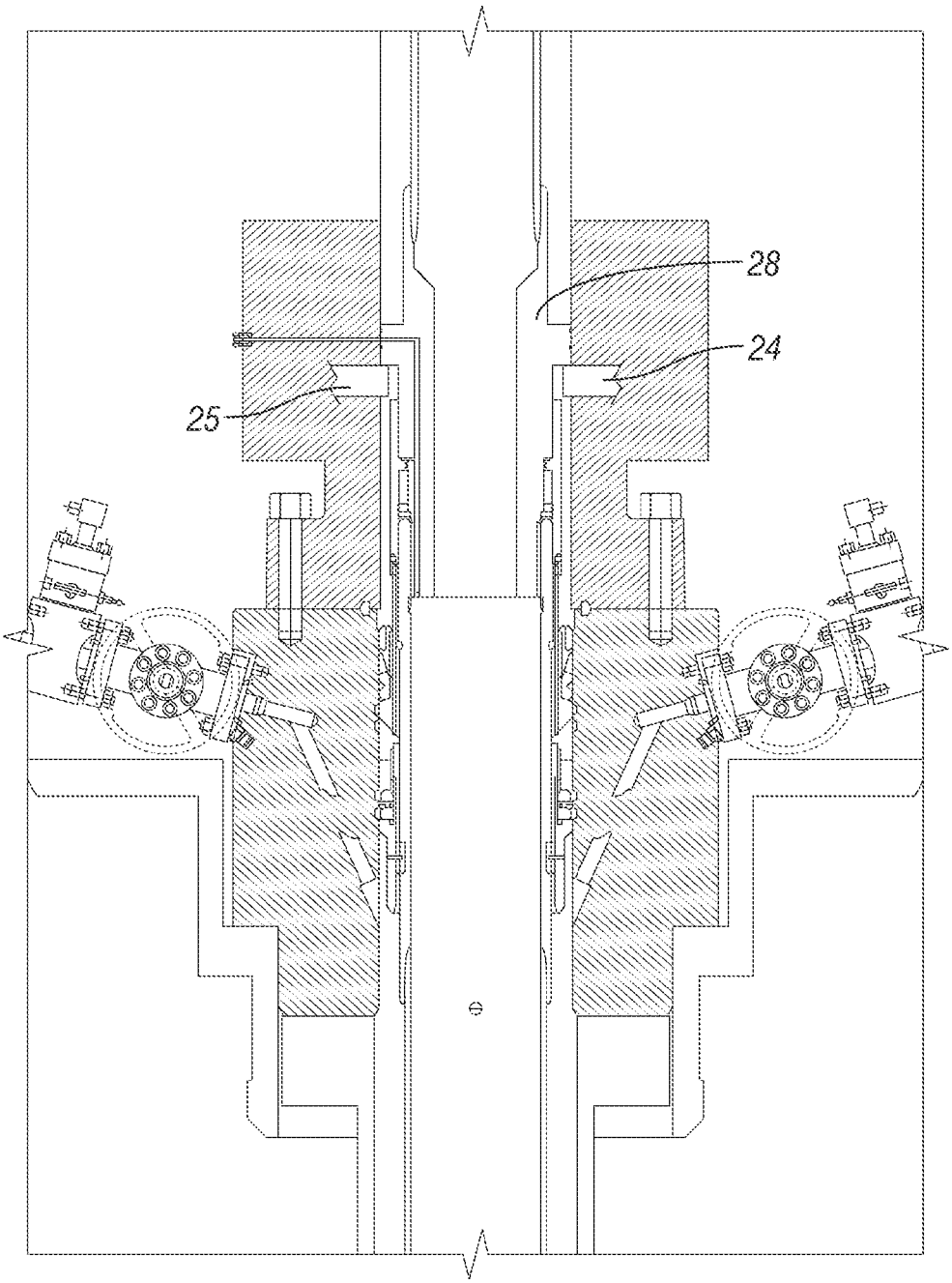
FIGS. 2-8 include sectional views of the full bore production system during installation.

FIGS. 2-8 show further installation of the hanger system 5. Referring to FIG. 2, at least the load pins 24, 25 are set into the extended position in the direction of the hanger running tool 28. (It should be noted that this embodiment could contain more than two load pins.) This movement may be actuated from variant sources, however, the conventional source is through manual operation. The purpose of moving the load pins 24, 25, is to locate and temporarily support the hanger system 5 and to provide verification of the elevation of the casing. This setting is known as the run-in position for the full bore production system 1.

Figure 3:
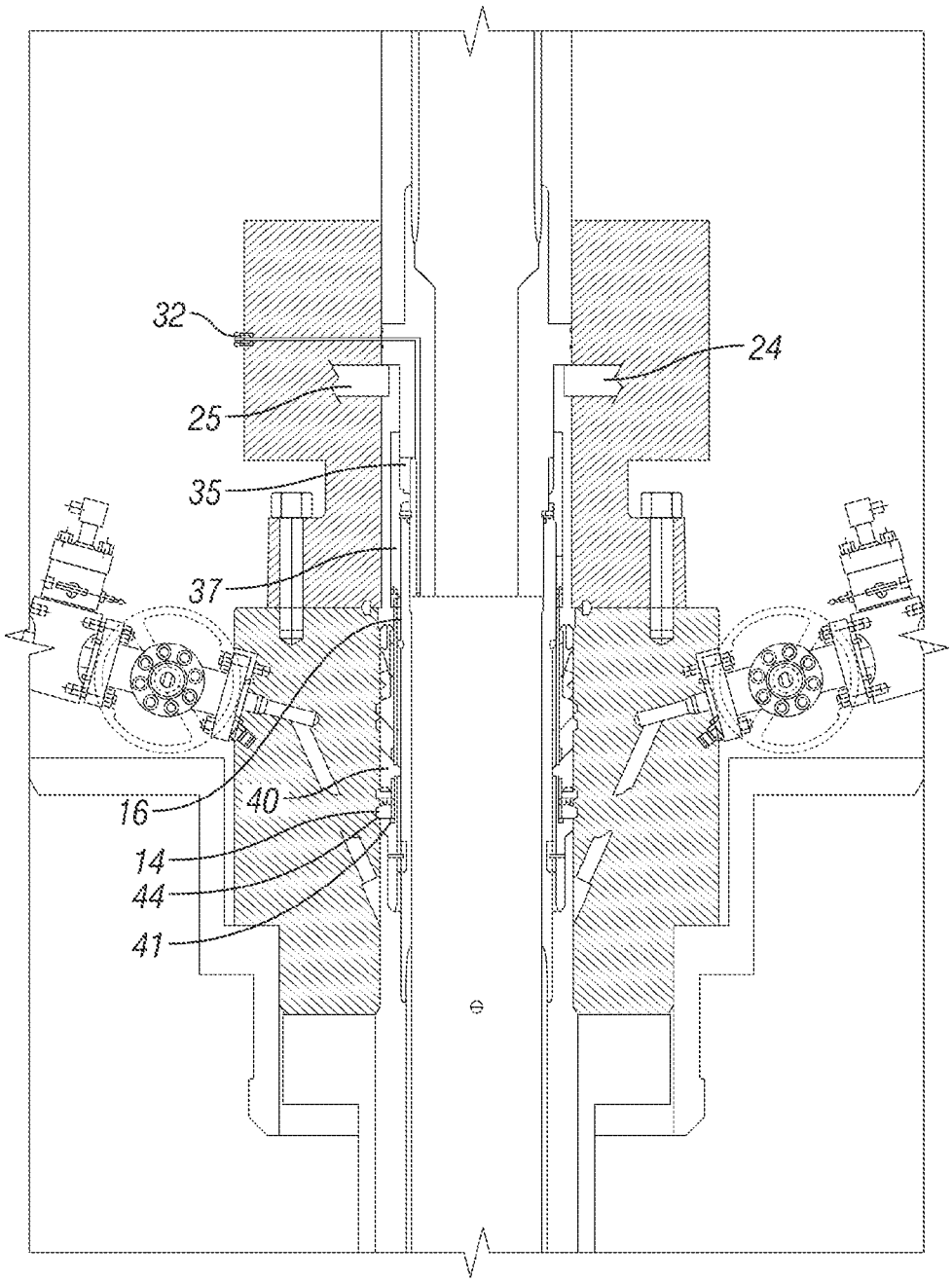

Referring to FIG. 3, hydraulic fluid pressure is applied through the pressure port 32 orifice to set and lock the load shoulder 12. Pressure is applied at pressure port 32 and this pressure load is introduced into the chamber 35 above an annular collar on the inside of the outer sleeve 37, effecting a hydraulic piston. The increased pressure in the chamber 35 is transferred to the outer sleeve 37 through the collar, shifting the sleeve 37 downward and applying pressure force to the stud force pin 16. This pressure loading of the stud force pin 16 transfers to the lower load sleeve 40, causing it and a wedge 41 to move downward. Movement of the wedge 41 relative to the load segment 14 causes the load segment 14 to move in a radially outward motion towards a groove 44 machined into the inner bore of the wellhead 4 until the load segment 14 is set in the groove 44. Once set, the load segment 14 may receive and support subsequent loading.

Figure 4:
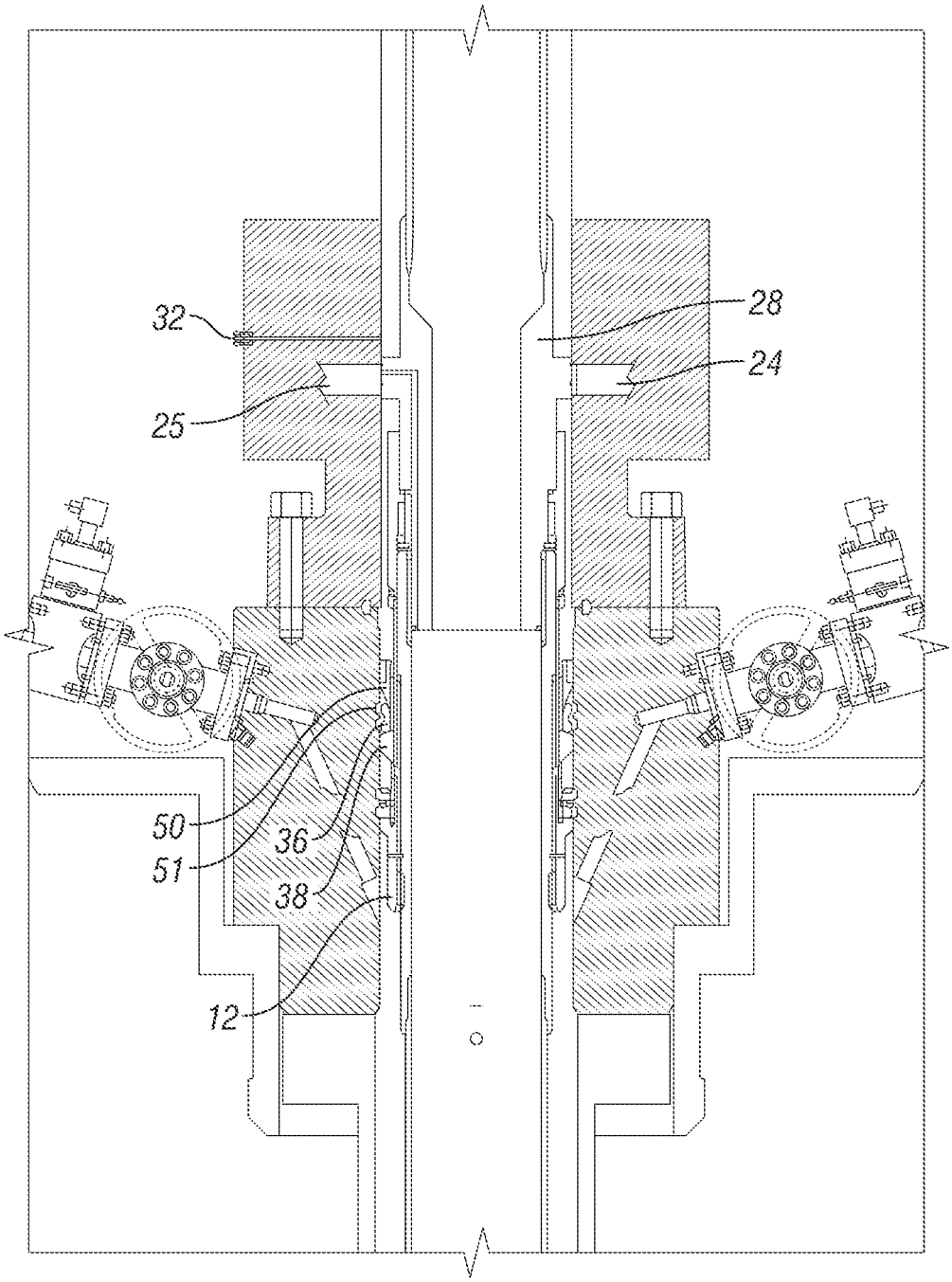

Referring to FIG. 4, with the load segment 14 extended, the hanger body 8 is supportable using the engagement of the load segment 14 with the groove 44 as a load shoulder. Transfer of the load to the load segment 14 is accomplished by retracting the load pins 24, 25 while holding the hanger body 8 using the running tool 28, and then slowly releasing the hanger body 8. With enough downward force, the hanger body 8 shears a force shear pin 42 located inside of a shear pin housing 48, allowing the hanger body 8 to continue to move in a downward direction until the hanger body 8 is supported by the load shoulder 12.

Figure 5:
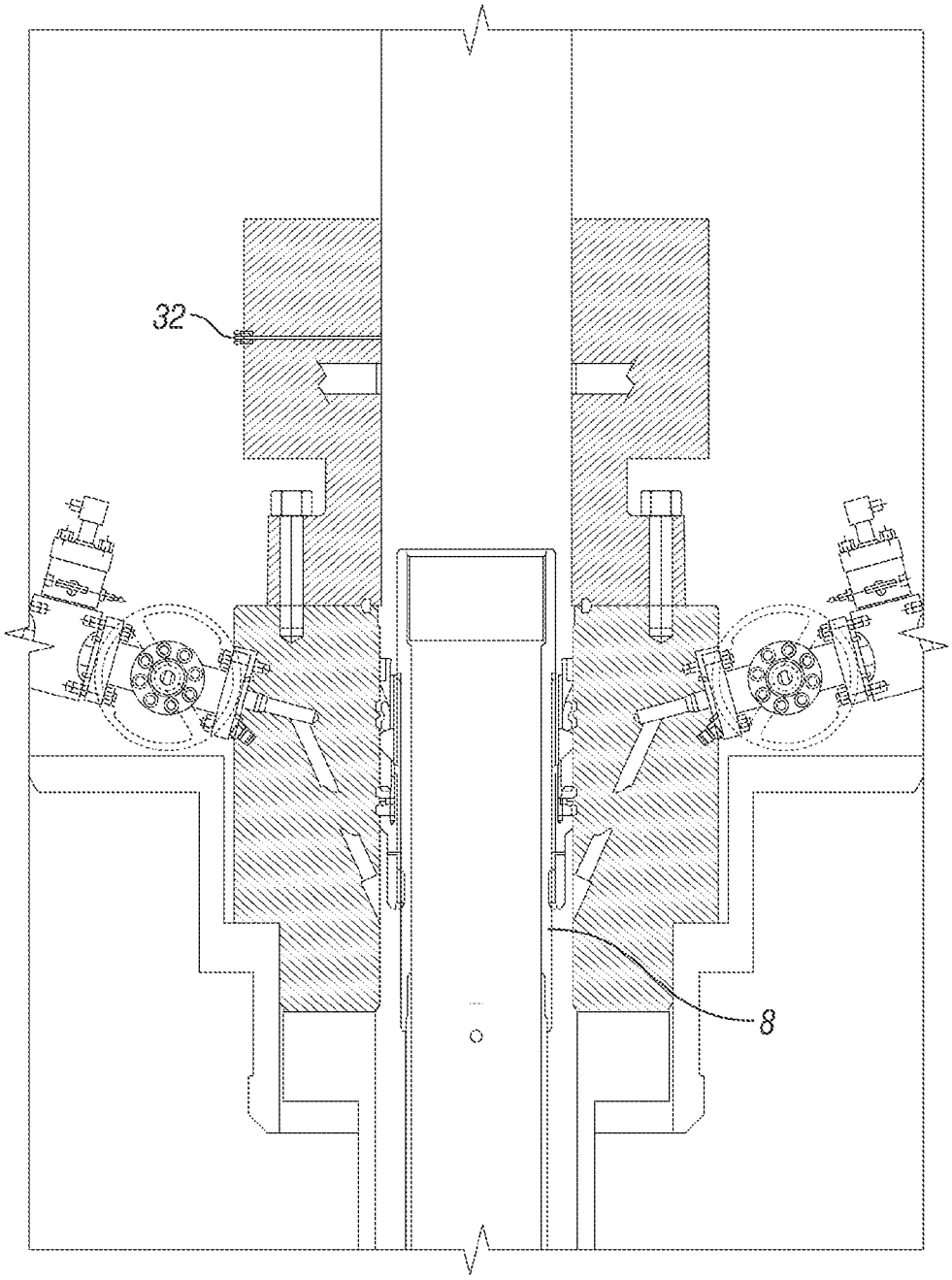

Referring to FIG. 5, once the hanger body 8 is landed, the pressure supplied to the system through pressure port 32 is terminated and the running tool 28 is removed.

Figure 6:
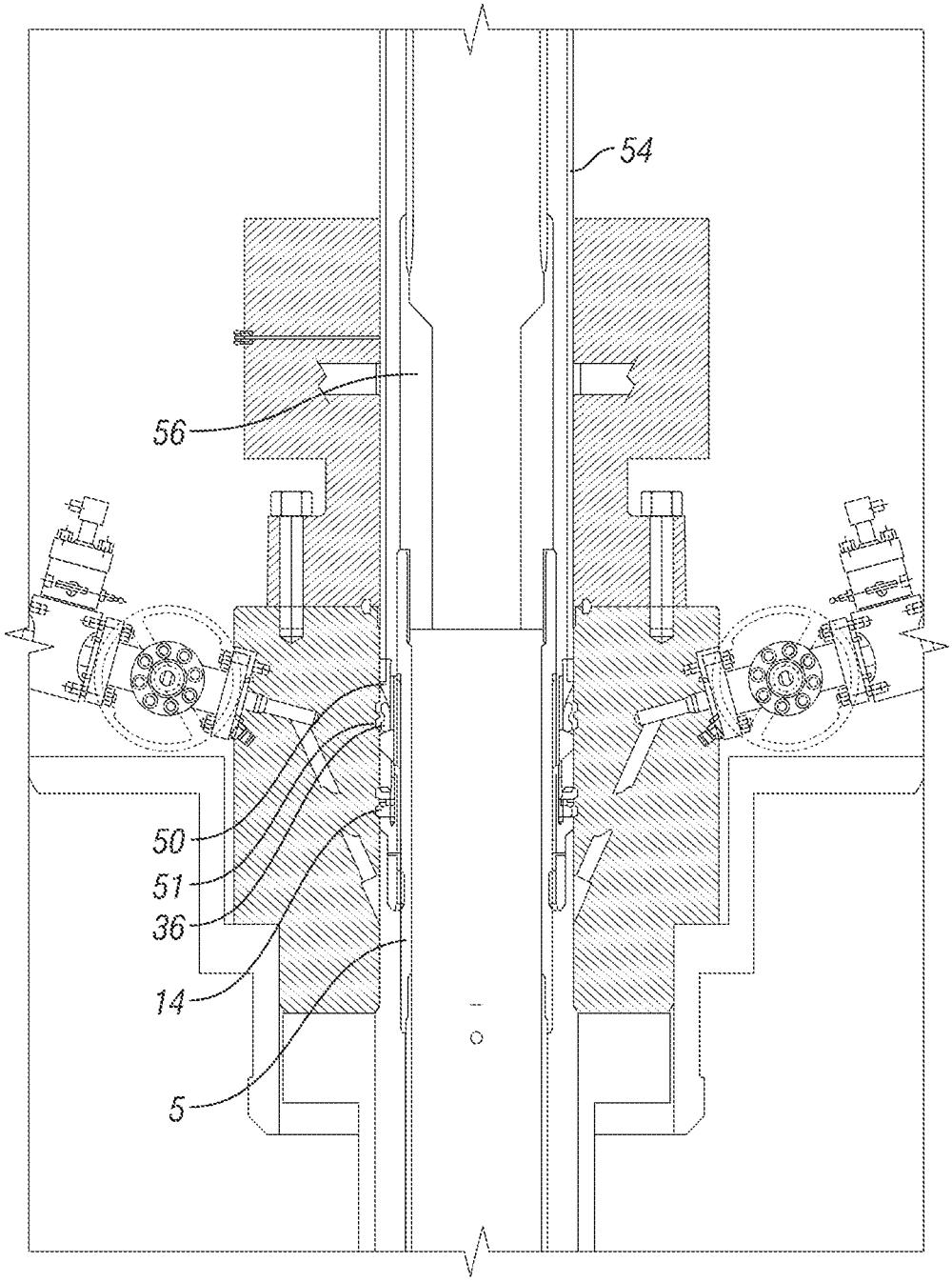

Referring to FIG. 6, an overshot tool 54 and an overpull tool 56 are positioned in the location previously occupied by hanger running tool 28. It should be appreciated that in the case that the tubing hanger body 8 is adjustable, overpull tool 56 may be used to position the adjustable hanger per the operator's specification and then to subsequently lock the hanger in place.

Figure 7:
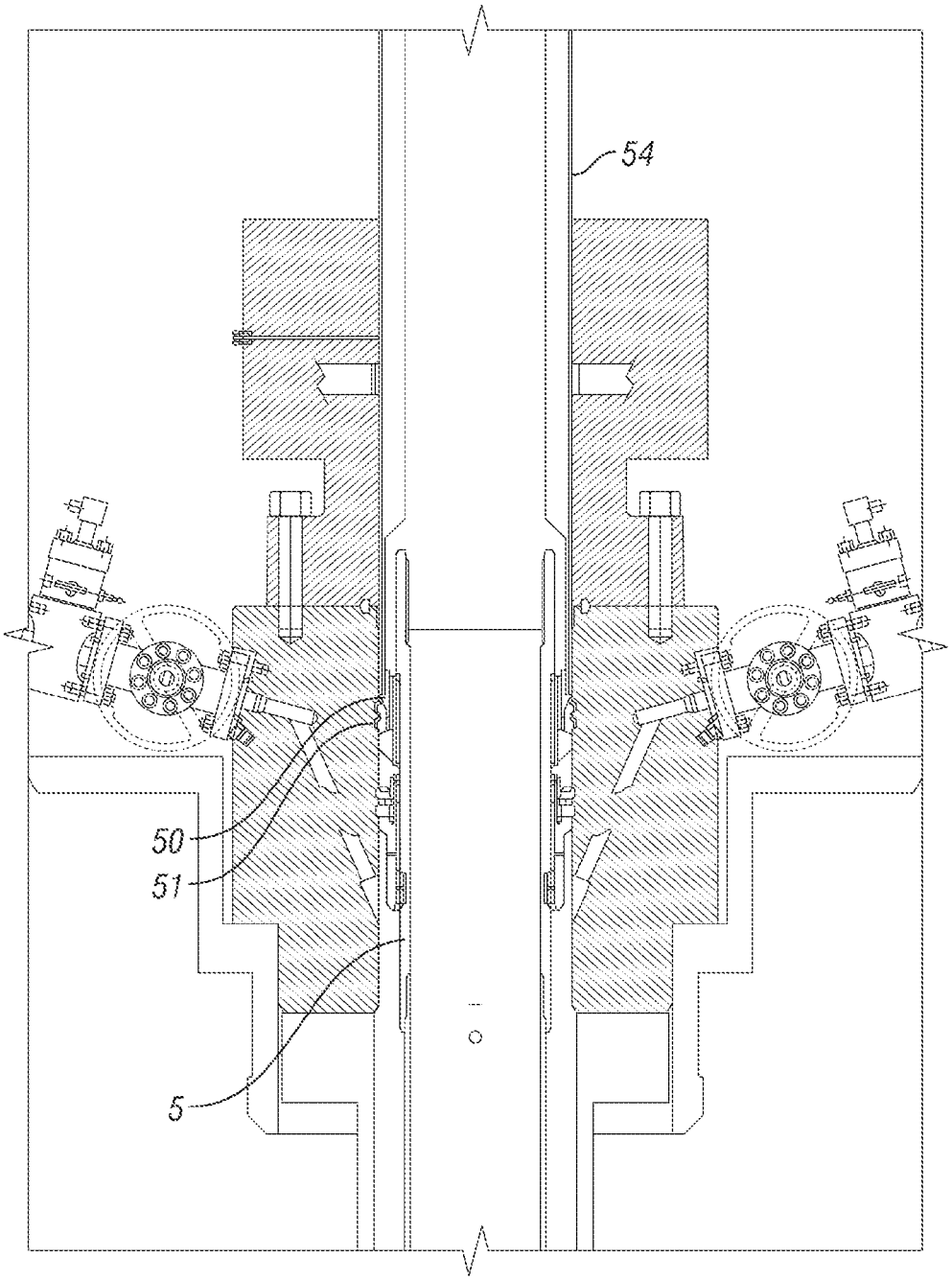
Figure 8:
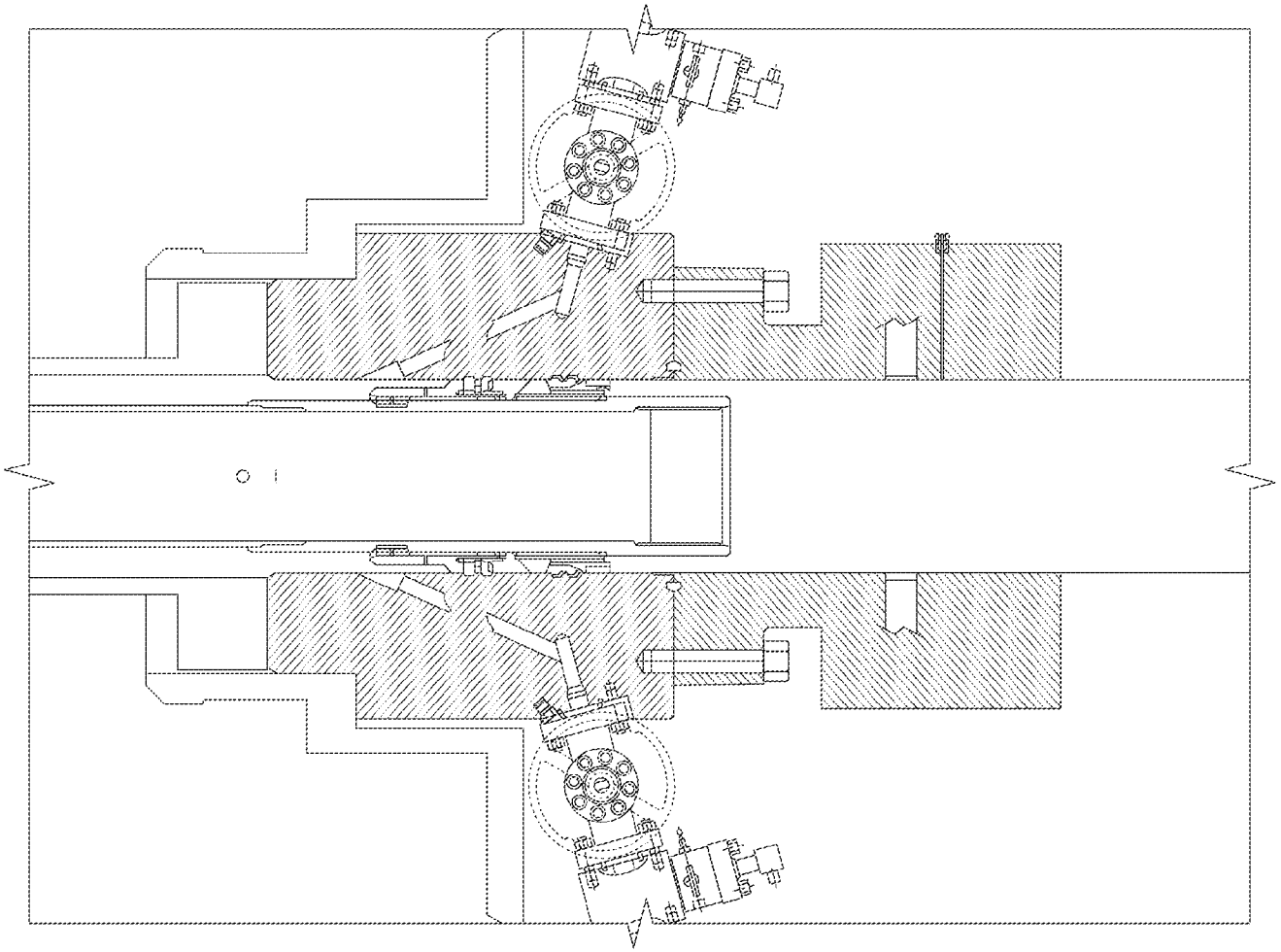

Referring to FIG. 7, once the hanger body 8 is positioned, the overshot tool 54 may be rotated to apply torque to the wedge 50, which is threaded to the outside of the upper load sleeve 38. Relative rotation of the wedge 50 to the upper load sleeve 38 drives the wedge 50 downward, applying an outward force to upper lock ring 36 and expanding the lock ring 36 into a groove 51. The movement of upper lock ring 36 towards the groove 51 allows for movement of the adjustable tubing hanger body 8 per the user's discretion. With the wedge 50 moved downward and the upper locking ring 36 engaged with the groove 51, the hanger body 8 is considered locked in position. The overshoot tool 54 may now be removed from the system as shown in FIG. 8.

Subsequent to installing the full bore system 1, operations may need to be performed on the well that include removal of the hanger system 5 and the supported production tubing. Removal of the hanger system 5, including the load shoulder 12 may be performed by unlocking and unsetting the hanger system 5 and then removing the system 5 from the wellhead 4. When removed, the wellhead 4 offers full bore access for running in tools or elements downhole for performing well operations such as workover procedures. The wellhead 4 thus does not limit the size of elements run into the well to a reduced inner diameter of a permanent load shoulder in the wellhead 4.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A production assembly for controlling production from a well, the assembly including:

a wellhead including a body and a bore through the body, the bore not including a hanger support shoulder but including an engagement profile extending into the body; and a tubing hanger assembly installable in the wellhead and including:

a load shoulder including a load segment expandable into supporting engagement with the bore engagement profile;

a tubing hanger and attached production tubing runnable in with the load shoulder and supportable on the load shoulder; and wherein the bore further includes an annular groove; and the tubing hanger assembly further includes a lock ring expandable into engagement with the groove to secure the tubing hanger to the load shoulder.

2. The production assembly of claim 1, further including an adapter mountable on the wellhead to selectively support the tubing hanger assembly.

3. The production assembly of claim 1, further including:

the adapter further including a load pin moveable between an extended position for supporting the tubing hanger assembly and a withdrawn position; and a tubing hanger running tool that can run the tubing hanger assembly into the wellhead and land on the load pin in the extended position to support the tubing hanger assembly.

4. The production assembly of claim 3, further including:

the adapter further including a hydraulic port extending through the load pin;

the running tool including a hydraulic port alignable for fluid communication with the adapter hydraulic port; and where hydraulic fluid communicated through the hydraulic ports can actuate the expansion of the load segment into engagement with the wellhead bore.

5. The production assembly of claim 3, wherein the tubing hanger is positionable by the running tool onto the load shoulder to transfer support of the tubing hanger to the load shoulder.

6. A production assembly for controlling production from a well, the assembly including:

a wellhead including a body and a bore through the body, the bore not including a hanger support shoulder but including an engagement profile extending into the body;

a tubing hanger assembly installable in the wellhead and including:

a load shoulder including a load segment expandable into supporting engagement with the bore engagement profile; and a tubing hanger and attached production tubing runnable in with the load shoulder and supportable on the load shoulder; and an adapter mountable on the wellhead to selectively support the tubing hanger assembly from above the wellhead.

7. The production assembly of claim 6, where:

the bore further includes an annular groove; and the tubing hanger assembly further includes a lock ring expandable into engagement with the groove to secure the tubing hanger to the load shoulder.

8. The production assembly of claim 6, further including:

the adapter further including a load pin moveable between an extended position for supporting the tubing hanger assembly and a withdrawn position; and a tubing hanger running tool that can run the tubing hanger assembly into the wellhead and land on the load pin in the extended position to support the tubing hanger assembly.

9. The production assembly of claim 8, further including:

the adapter further including a hydraulic port extending through the load pin;

the running tool including a hydraulic port alignable for fluid communication with the adapter hydraulic port; and where hydraulic fluid communicated through the hydraulic ports can actuate the expansion of the load segment into engagement with the wellhead bore.

10. The production assembly of claim 8, wherein the tubing hanger is positionable by the running tool onto the load shoulder to transfer support of the tubing hanger to the load shoulder.

11. A method of completing a well including:

installing a wellhead including a body and a bore through the body, the bore not including a hanger support shoulder;

installing a tubing hanger assembly including a tubing hanger and attached production tubing in the wellhead bore by expanding a portion of the hanger assembly into supporting engagement with an engagement profile in the bore wall; and wherein the expanding a portion of the tubing hanger assembly includes expanding a load segment of a load shoulder into engagement with the engagement profile in the bore wall.

12. The method of claim 11, further including securing the tubing hanger in place by expanding a portion of the tubing hanger assembly into engagement with an annular groove in the bore wall.

13. The method of claim 11, further including selectively supporting the tubing hanger assembly with an adapter mounted on the wellhead.

14. The method of claim 11, further including:

selectively supporting the tubing hanger assembly with an adapter mounted on the wellhead by extending a load pin into an extended position into a bore of the adapter aligned with the wellhead bore; and running the tubing hanger assembly using a tubing hanger running tool and landing the running tool on the load pin.

15. The method of claim 14, further including:

aligning a hydraulic port in the running tool for fluid communication with a hydraulic port extending through the load pin; and actuating expansion of the portion of the hanger assembly into engagement with the wellhead bore by communicating hydraulic fluid through the hydraulic ports.

16. The method of claim 14, further including:

where expanding a portion of the tubing hanger assembly includes expanding a load segment of a load shoulder into engagement with the profile in the bore wall;

withdrawing the load pin to a withdrawn position; and positioning the tubing hanger onto the load shoulder with the running tool to transfer support of the tubing hanger to the load shoulder.

17. The method of claim 11, further including producing hydrocarbon fluids from the well through the production tubing.

* * * * *